US008359119B2

(12) United States Patent
Schmors et al.

(10) Patent No.: US 8,359,119 B2
(45) Date of Patent: Jan. 22, 2013

(54) METHOD FOR ASSISTING AT LEAST PARTIALLY MANUAL CONTROL OF A METAL PROCESSING LINE

(75) Inventors: Stefan Schmors, Worpswede (DE); Klaus Weinzierl, Nürnberg (DE)

(73) Assignee: Siemens Aktiengesellschaft, Munich (DE)

( * ) Notice: Subject to any disclaimer, the term of this patent is extended or adjusted under 35 U.S.C. 154(b) by 362 days.

(21) Appl. No.: 12/526,603

(22) PCT Filed: Feb. 6, 2008

(86) PCT No.: PCT/EP2008/051450

§ 371 (c)(1), (2), (4) Date: Aug. 10, 2009

(87) PCT Pub. No.: WO2008/098863

PCT Pub. Date: Aug. 21, 2008

(65) Prior Publication Data

US 2010/0131092 A1 May 27, 2010

(30) Foreign Application Priority Data

Feb. 15, 2007 (DE) ..... 10-2007-007-560

(51) Int. Cl.
*G06F 19/00* (2006.01)
*G06F 7/60* (2006.01)
*C21D 11/00* (2006.01)

(52) U.S. Cl. ..... 700/145; 700/147; 703/2; 148/511

(58) Field of Classification Search ..... 700/145, 700/147; 703/2; 72/6.1; 148/511, 654
See application file for complete search history.

(56) References Cited

U.S. PATENT DOCUMENTS

| | | | | |
|---|---|---|---|---|
| 3,905,216 | A | 9/1975 | Hinrichsen | |
| 5,170,367 | A * | 12/1992 | Mackay et al. | 702/22 |
| 5,891,275 | A * | 4/1999 | Elfmark et al. | 148/654 |
| 6,327,883 | B1 * | 12/2001 | Noe et al. | 72/8.5 |
| 7,085,619 | B2 * | 8/2006 | Broese et al. | 700/164 |
| 7,197,802 | B2 * | 4/2007 | Kurz et al. | 29/407.01 |
| 7,601,096 | B2 * | 10/2009 | Negrin | 482/4 |
| 7,853,348 | B2 * | 12/2010 | Weinzierl | 700/147 |

(Continued)

FOREIGN PATENT DOCUMENTS

RU 2211102 C1 8/2003

(Continued)

OTHER PUBLICATIONS

International Search Report, PCT/EP2006/061450, 17 pages, Jun. 4, 2006.

(Continued)

*Primary Examiner* — Mohammad Ali
*Assistant Examiner* — Sivalingam Sivanesan
(74) *Attorney, Agent, or Firm* — King & Spalding L.L.P.

(57) ABSTRACT

In a method for assisting at least partially manual control of a metal processing line (1), in which metal (4) in strip or slab form or a pre-profiled state is worked, the proportion of at least one metallurgical phase of the metal is continuously determined with respect to at least one specific location of the metal processing line while taking into account operating parameters of the metal processing line (1) that influence the phase state and/or state parameters of the metal, and the proportion of the least one phase with respect to the specific location of the metal processing line is indicated to an operator.

20 Claims, 2 Drawing Sheets

U.S. PATENT DOCUMENTS

| | | | | |
|---|---|---|---|---|
| 7,865,341 | B2 * | 1/2011 | Borchers et al. | 703/6 |
| 2004/0205951 | A1 * | 10/2004 | Kurz et al. | 29/407.05 |
| 2005/0016712 | A1 * | 1/2005 | Franz et al. | 164/452 |
| 2006/0117549 | A1 | 6/2006 | Plococnnik et al. | 29/592.1 |
| 2006/0225474 | A1 * | 10/2006 | Reinschke et al. | 72/8.5 |

FOREIGN PATENT DOCUMENTS

| | | | |
|---|---|---|---|
| SU | 850706 | A1 | 7/1981 |
| SU | 1696028 | A1 | 12/1991 |
| UA | 82498 | C2 | 4/2008 |
| WO | WO 2004/076085 | A2 | 9/2004 |
| WO | WO 2004/085087 | A2 | 10/2004 |
| WO | WO 2005/076092 | A1 | 8/2005 |
| WO | WO 2005/099923 | A1 | 10/2005 |

OTHER PUBLICATIONS

German Office Action, German application No. 10 2007 007 560.1-55, 3 pages, Aug. 20, 2007.

Brochure:"Hot Rolled Steel Strip," Ausgabe 2005 der Firma ThyssenKrupp (Hoesch Hohenlimburg GmbH, Gesechaftsbereuich Mittelband, Oeger Strasse 120, 58119 Hagen).

Report: J. Herman et al. "Computer Assisted Modelling of Metallurgical Aspects of Hot Deformation and Transformation of Steels," ISBN 92-828-1438-6, Report der European Commission "Technical Steel Research,".

* cited by examiner

FIG 3A
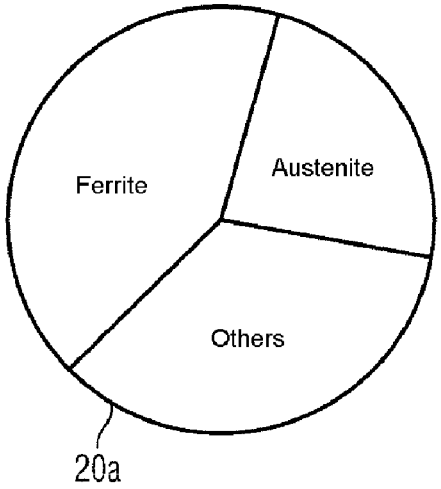
FIG 3B
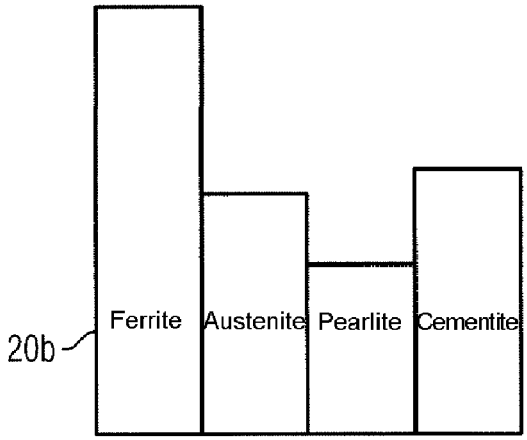
FIG 3C
| | | |
|---|---|---|
| | Ferrite | 10% |
| 20c | Austenite | 80% |
| | Others | 10% |
FIG 3D
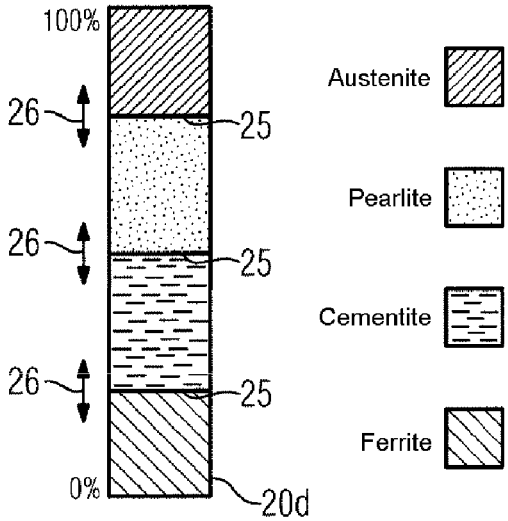
FIG 4
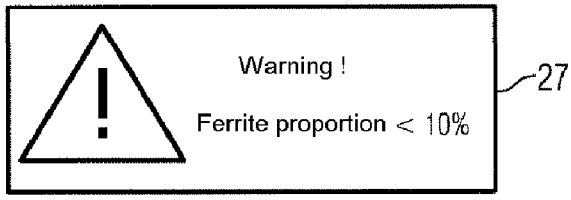

METHOD FOR ASSISTING AT LEAST PARTIALLY MANUAL CONTROL OF A METAL PROCESSING LINE

CROSS-REFERENCE TO RELATED APPLICATIONS

This application is a U.S. National Stage Application of International Application No. PCT/EP2008/051450 filed Feb. 6, 2008, which designates the United States of America, and claims priority to German Application No. 10 2007 007 560.1 filed Feb. 15, 2007, the contents of which are hereby incorporated by reference in their entirety.

TECHNICAL FIELD

The invention relates to a method for assisting at least partially manual control of a metal working line in which metal in strip or slab form or in a pre-profiled state is worked, and to a metal working line.

BACKGROUND

Metal working lines of this type—for example production lines for rolling the metal, cooling sections for cooling the metal or a combination of the two—are generally known. In these working lines, phase states of the metal which are determined as precisely as possible are frequently required in the end product or else for specific working steps; this means that specific phase proportions of different phases of the metal, in particular of the steel, are predetermined as target values. Adhering to these target values is an essential criterion for the quality of the metal.

In order to adhere to the desired phase state of the metal as precisely as possible in an automatically controlled system, WO 2005/099923 A1 has proposed, for example, the use of a phase conversion model, the determination of at least one phase proportion at points of the metal monitored for displacement taking into account displacement monitoring, the operating parameters of the metal working line, the primary data, which describe the metal running into the metal working line and the state of said metal, and measured values, and corresponding control of a cooling section on the basis of the result.

However, automatic control cannot actually provide the desired target parameters (for example phase proportions, temperature, thickness and the like) of the worked metal in every process, and so systems having at least partially manual control are known. In these systems, an operator can manually control diverse components, for example actuators for cooling, roller tables or rollers, in order to set the parameters to the desired target parameters. At the end of the working line, for example, the temperature is then measured and displayed to the operator, for example at the end of a cooling section. Different settings of operating parameters may lead to the same temperature but to different phase states of the metal, and this may lead to the production of scrap of which the operator is unaware. This is also accompanied by a poorer quality of the worked metal. Working may also fail on account of the incorrect phase state and so-called cobbles may occur in the system, that is to say the metal becomes jammed or caught up in the system, and this may lead at least to a stoppage of the system. A cobble of this type also puts the safety of any persons present at risk.

SUMMARY

According to various embodiments, a method for assisting at least partially manual control of a metal working line can be specified, which method allows an operator to carry out improved setting with respect to target parameters and therefore increases the quality of the worked metal, reduces the production of scrap and prevents cobbles.

According to an embodiment, a method for assisting at least partially manual control of a metal working line in which metal in strip or slab form or in a pre-profiled state is worked, may comprise the steps of: determining the proportion of at least one metallurgical phase of the metal continuously with respect to at least one specific location of the metal working line taking into account at least one of operating parameters of the metal working line that influence the phase state and state parameters of the metal, and displaying the proportion of the at least one phase with respect to the specific location of the metal working line to an operator.

According to a further embodiment, the proportion can be determined using a model for determining the phase state of the metal at different points of the metal, wherein displacement monitoring of at least one of the points of the metal and primary data, which describe the metal running into the metal working line and the state of said metal, are taken into account. According to a further embodiment, at least one measuring device for recording state parameters, in particular a pyrometer, may be used. According to a further embodiment, the metal may be worked in a metal working line which is in the form of a cooling section for cooling the metal.

According to a further embodiment, the state parameters used may be measured values from a first pyrometer, which is arranged upstream of the cooling section, and from a second pyrometer, which is arranged downstream of the cooling section. According to a further embodiment, the proportion may be displayed with respect to a location at the end of the working line. According to a further embodiment, in addition to determining the current proportion, when the control of at least one component of the working line is changed, a prognosis for the future proportion may also be determined and displayed taking into account the changed control at the location. According to a further embodiment, a test mode may be selected, in which the changed control is not adopted immediately. According to a further embodiment, the proportion of at least one of austenitic, ferritic, pearlitic, cementitic, and further phases may be determined and displayed. According to a further embodiment, the proportion may be displayed in the form of at least one of a curve, as a pie chart, in numerical form, as a bar chart, and as color graphics. According to a further embodiment, a warning message may be emitted when at least one predetermined value for at least one proportion at the location is undershot or exceeded.

According to another embodiment, a metal working line for handling metal in strip or slab form or in a pre-profiled state, may have a control device comprising a computation unit operable to continuously determine the proportion of at least one metallurgical phase of the metal with respect to at least one specific location of the metal working line taking into account at least one of operating parameters that influence the phase state and state parameters of the metal, an input apparatus for the at least partially manual control of the operation of the metal working line, and a display apparatus designed to display the proportion of the at least one phase with respect to the specific location of the metal working line.

According to a further embodiment, the proportion may be determined by providing the computation unit with a model for determining the phase state of the metal at different points of the metal, taking into account displacement monitoring of at least one of the points of the metal and primary data which describe the metal running into the metal working line and the state of said metal. According to a further embodiment, the metal working line may comprise at least one measuring device for recording state parameters, in particular a pyrometer. According to a further embodiment, the metal working line may be a cooling section comprising actuators for influencing the temperature of the metal. According to a further embodiment, a pyrometer may be provided both at the start and at the end of the cooling section, wherein the computation unit is designed for taking into account the measured values from the pyrometers as state parameters. According to a further embodiment, the display apparatus can be designed for displaying the proportion in the form of a curve and/or as a pie chart and/or in numerical form and/or as a bar chart and/or as color graphics. According to a further embodiment, the metal working line may be designed for carrying out the method as described above.

BRIEF DESCRIPTION OF THE DRAWINGS

Further advantages and details of the present invention will become apparent from the exemplary embodiment described below, and with reference to the drawings, in which:

FIGS. 3A-D show possible representations of phase proportions, and FIG. 4 shows a possible warning message.

DETAILED DESCRIPTION

Figure 1:
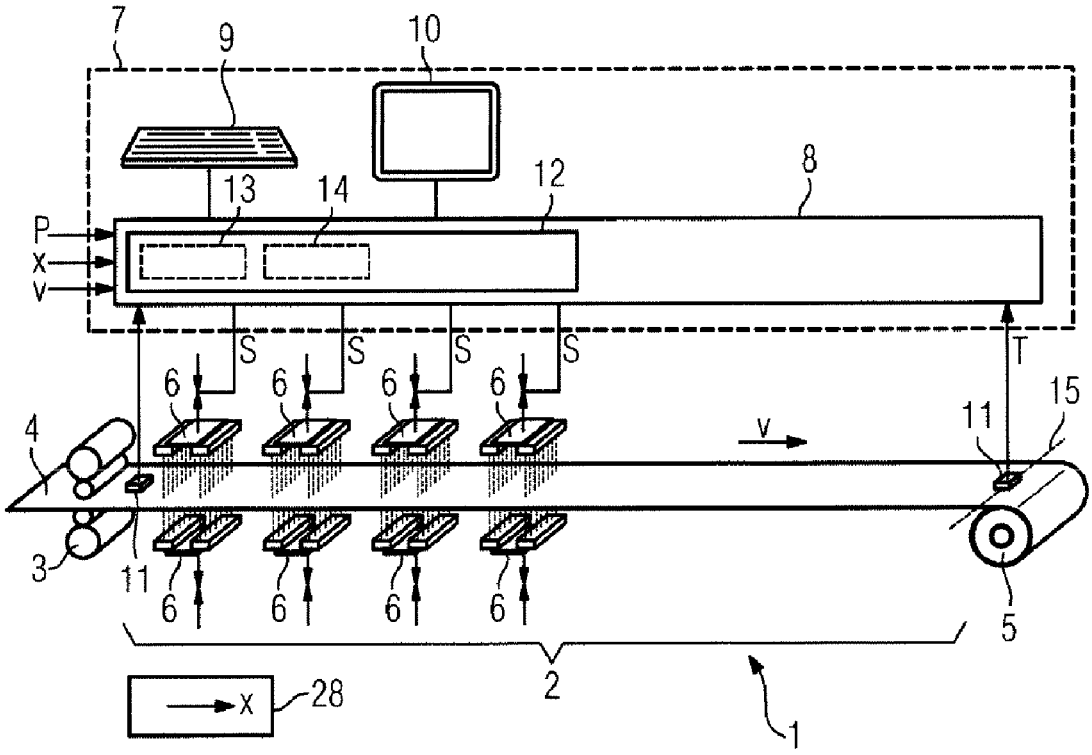
FIG. 1 shows a metal working line according to an embodiment.

According to various embodiments, in the case of a method of the type mentioned initially, there is provided that the proportion of at least one metallurgical phase of the metal is determined continuously with respect to at least one specific location of the metal working line taking into account operating parameters of the metal working line that influence the phase state and/or state parameters of the metal, and the proportion of the at least one phase with respect to the specific location of the metal working line is displayed to an operator.

According to various embodiments, first of all the proportion of at least one phase is therefore determined at a specific location of the metal working line which is particularly relevant for the working process. The result of the determination may also be used for the partially automatic control of the metal working line. However, in the method according to various embodiments, it may also be advantageously displayed to an operator in real time, for example on a control device. The operator therefore receives up-to-date information which is relevant for the quality of the worked metal and immediately represents the influence of manual controls carried out by him, and so it may be possible to further optimize the manual settings by means of further changes. Therefore, the display is used for quality assurance, but also prevents cobbles and the production of scrap and increases the safety on the metal working line. In particular, the display may also be used when the metal working line is operated in an automatic mode, such that the occurrence of a quality problem can be detected in good time and a change to manual control can be made in order to perform appropriate corrections. In general terms, however, the term "manual control" in this context should also be understood to mean minimal intervention—briefly any type of user information which influences the operating sequence, no matter how slightly. One example of such manual intervention, which also represents manual control, is the selection of a suitable cooling plan or suitable cooling parameters.

The proportion may be determined, in particular, using a model for determining the phase state of the metal at different points of the metal (defined locations on the metal), wherein displacement monitoring of the points of the metal and/or primary data, which describe the metal running into the metal working line and the state of said metal, are taken into account. Models of this type provide reliable statements about the phase state of the metal at different points of the metal. The model is initialized for every point of the metal running into the metal working line, if appropriate on the basis of a measurement. All of the points of the metal located in the line are monitored for displacement. Since the displacement monitoring and the operating parameters mean that the influences on all the points of the metal are known, it is possible to continuously update the phase state at each of the points of the metal under consideration. For the display, it is then merely necessary to retrieve the appropriate information at the specific location of the metal working line. By way of example, this information may be gathered from the point of the metal closest to the specific location. The model may also be integrated in a superordinate model, for example with a temperature model. It is, of course, also possible to use other methods in order to determine the phase proportion(s), for example measurement processes.

As already mentioned, measured variables may also be included in the determination of the phase state of the metal. For this purpose, it may be provided that at least one measuring device for recording state parameters, in particular a pyrometer, is used. A pyrometer makes it possible to measure the temperature at a specific point of the metal such that, for example, the model can be initialized at such a point, in particular in association with the primary data. It goes without saying that state parameters may also be used to adapt the model in that, for example, a measured value suggests correction of the phase state determined by the model.

The metal working line may be any type of metal working line in which the phase state of the metal plays an important role. Therefore, by way of example, the metal working line may be a production line in which ferritic rolling is provided. Ferritic metal can be rolled with a lower rolling force than, for example, austenitic metal. It is important here that the conversion point from ferrite into austenite is known as precisely as possible and is between two specific roll stands. Then, it may be provided in the method according to various embodiments, for example, that the phase proportion at each roll stand is displayed. This allows ferritic rolling to take place since the operator has an overview of the phase states of the metal at all times and can, if appropriate, intervene in the rolling process by manual control.

However, the method can be used particularly advantageously when the metal is worked in a metal working line which is in the form of a cooling section for cooling the metal. Cooling sections frequently adjoin a production line and are used to prepare the metal for removal. By way of example, a coiler onto which the worked metal is coiled may therefore be provided at the end of the cooling section. Of course, it is equally possible for further working to take place or for a different removal or storage device to be provided at the end of the cooling section. One example thereof is the heavy plate line. Since coiling cannot take place there, the plates are instead straightened in a stretcher-leveler and stored like plates. A cooling section of this type is provided with actuators which serve to influence the temperature of the metal and therefore also influence the phase proportions. By way of example, a cooling section may have valves which are arranged above and below a roller table and by means of which coolant, in particular water, is applied to the metal. By way of example, the water quantity and the water pressure may be controlled manually or automatically. The temperature of the metal is frequently measured at the start and at the end of the cooling section. It may therefore be provided that the state parameters used are measured values from a first pyrometer, which is arranged upstream of the cooling section, and from a second pyrometer, which is arranged downstream of the cooling section. It goes without saying that other temperature measurements can also be carried out. Together with primary data and general information about the metal running in, for example that the metal is formed 100% from austenite, the measured values from the first pyrometer can be used to initialize the phase proportions at a point of the metal. The second pyrometer ultimately serves for control and for adaptation of the model.

It goes without saying that overall production can also be considered, that is a combination of production line and cooling section, for example.

In order to be able to assess the quality of the worked metal ideally at the relevant location, the proportion is expediently displayed with respect to a location at the end of the working line, that is for example at the end of the cooling section, before reeling onto a coiler which may be provided. It can then be immediately assessed whether the desired target parameters are achieved with the current operating parameters.

By way of example, if a cooling section about 70 meters long is considered, a strip moving rapidly, for example at a velocity of 10 meters/second, needs 7 seconds to pass through the cooling section. However, slower velocities are also frequently customary, for example 2 meters/second, and so the metal needs half a minute to pass through the cooling section. If changed control is performed at the start of the cooling section, the real-time display has the effect, for example at a location at the end of the metal working line, that an operator can only observe the effects on the display after several seconds or even half a minute.

Therefore, it may be provided in an advantageous development of the method that, in addition to determining the current proportion, when the control of at least one component of the working line is changed, a prognosis for the future proportion is also determined and displayed taking into account the changed control at the location. With knowledge of the current operating parameters and the current phase proportions at the position at which the changed control is performed, this means that it is possible to carry out a precalculation from this position as far as the location with respect to which the display is carried out, and so the effect of the change is immediately apparent to an operator, especially when the comparative value with the previous settings is still also being displayed to him. A prognosis of this type—which, however, clearly cannot yet allow for subsequent changes to the working process which are not controlled by the operator, for example an unplanned increase in the transportation velocity—provides the operator with early indications as to the type of effect a change in the control has. It may also be provided particularly advantageously that a test mode can be selected. In this test mode, it is possible to stipulate changes of the control at the user interface, even though these cannot be undertaken immediately. Nevertheless, the determination of the phase proportions and the known changed and unchanged operating parameters makes it possible to create a prognosis which displays which effects the intended change will have. If the operator is satisfied, he may adopt the changes in the control, for example by activating a further operator control element.

There are complex phase diagrams containing a large number of different phases for metals, in particular for carbon-containing steels. It is not expedient to determine and display the proportions of all these phases. Therefore, primarily relevant phases are preferably displayed. In particular, it may be provided that the proportion of austenitic and/or ferritic and/or pearlitic and/or cementitic and/or further phases is determined and displayed.

The proportion may be displayed in any desired form which is easy to understand and clear. Therefore, the proportion may expediently be displayed in the form of a curve and/or as a pie chart and/or in numerical form and/or as a bar chart and/or as color graphics. Particularly advantageously, it may also be provided that a warning message is emitted when at least one predetermined value for at least one proportion at the location is undershot or exceeded. By way of example, it is therefore possible to predetermine tolerance values which represent a quality tolerance and should be adhered to. The warning message, which can be emitted visually and/or audibly, diverts the operator's attention to the problem which has occurred and to the display of the phase proportion(s), and suitable countermeasures can be taken.

In addition, according to various embodiments, a metal working line for handling metal in strip or slab form or in a pre-profiled state, may have a control device comprising a computation unit designed to continuously determine the proportion of at least one metallurgical phase of the metal with respect to at least one specific location of the metal working line taking into account operating parameters that influence the phase state and/or state parameters of the metal, an input apparatus for the at least partially manual control of the operation of the metal working line, which is possible selectively, and a display apparatus designed to display the proportion of the at least one phase with respect to the specific location of the metal working line. In particular, a metal working line of this type is designed for carrying out the method as described above, and the embodiments relating to the method can be transferred to the metal working line. The computation unit therefore receives signals which indicate the state of the metal or of the metal working line in the form of operating parameters and/or state parameters. After the at least one phase has been determined, corresponding signals are sent to the display apparatus, and the display can therefore take place.

It may therefore be provided that the proportion is determined by providing the computation unit with a model for determining the phase state of the metal at different points of the metal, taking into account displacement monitoring of the points of the metal and/or primary data which describe the metal running into the metal working line and the state of said metal. A model of this type may, for example, also be part of a more comprehensive model of the metal working line which may additionally comprise, for example, a temperature model. Expediently, the metal working line may comprise a measuring device for recording state parameters, in particular a pyrometer.

The metal working line may be any desired type of working line, for example a production line or a completion line. It is particularly advantageous when the metal working line is in the form of a cooling section comprising actuators for influencing the temperature of the metal. Pyrometers may be provided at the start and at the end of such a cooling section, wherein the computation unit is designed for taking into account the measured values from the pyrometers as state parameters. Of course, it is also possible to provide further pyrometers or other measuring devices.

The display apparatus may be designed for displaying the proportion in the form of a curve and/or as a pie chart and/or in numerical form and/or as a bar chart and/or as color graphics.

Finally, it should be noted that the invention can advantageously be used not only for the working of metal in strip or slab form. Particularly in the handling of metal in a pre-profiled state, for example the production of pipes or profiles, manual control options are frequently provided, and so productive use is also possible here.

FIG. 1 shows a metal working line 1 which here is in the form of a cooling line 2. The cooling line 2 is arranged downstream of a production line, the last roll stand of which is indicated at 3. A metal 4 to be worked, here in strip form, firstly passes through the production line and then the cooling section 2, whereupon it is coiled onto a coiler 5, which is arranged downstream of the cooling section 2, in order to be transported away or for intermediate storage for further working.

The cooling section 2 comprises actuators 6 which are used to influence the temperature of the metal 4. In this case, the actuators 6 comprise flaps and valves which make it possible to apply water to the metal 4 in strip form, in order to cool the latter. Although only a few actuators 6 are shown in the drawing, the cooling section may comprise a large number of such actuators 6.

The cooling section 2 also comprises a control device 7, which is shown schematically in FIG. 1. The control device 7 comprises a computation unit 8, an input apparatus 9 for the partially manual control of the actuators and a display apparatus 10. Furthermore, a pyrometer 11 for measuring the temperature of the metal 4 is arranged both upstream and downstream of the cooling line.

The computation unit 8 controls the actuators 6 (e.g. valves, nozzles or flaps etc.) according to operating parameters S which can be at least partially changed by an operator in a manual operating mode by means of the input apparatus 9, and so the actuators 6 can be controlled in groups or separately. The ability to perform manual control does not have to be provided permanently; it is just as readily conceivable that a changeover can be made between an automatic operating mode and a manual operating mode. Furthermore, it is conceivable that parts of the actuators 6 can be designed separately for manual control. Furthermore, it is conceivable for the operator to vary input variables of automatic operation, e.g. an amplification factor which increases the water quantity when the velocity of the strip increases (semi-automatic). Examples of other manual interventions which represent manual control are changing primary data (e.g. desired temperature of the coiler), changing the cooling strategy (e.g. cooling gradient), changing the length of uncooled strip sections or else quality assessment, which does not represent a change to the automatic system itself.

In addition, the computation unit 8 receives further information relating to the state of the cooling section 2 or of the metal 4. In addition to the measured values T from the pyrometers 11, the computation unit 8 is supplied with primary data P of the metal 4, which describe the metal 4 or the state thereof as it passes into the cooling section 2, and the metal velocity v as a further operating parameter.

Furthermore, displacement monitoring 28 is provided, and this continuously tracks the position of a point of the metal 4 as the latter passes through the cooling section 2. The displacement monitoring 28 may also be integrated in the computation unit 8; in any case, the data from the displacement monitoring 28 are also available to the computation unit 8.

A model 12 of the cooling section 2 is then stored in the computation unit 8, and this model comprises a model 13 for determining the phase state of the metal 4 at different points of the metal and a temperature model 14 for determining the temperature or the temperature distribution of the metal 4 at different points of the metal. The models 13 and 14 may also be implemented as a common model. The model 13 is designed for determining the proportion of at least one phase of the metal at a plurality of points of the metal taking into account the operating parameters S that influence the phase state, the state parameters of the metal 4, here the measured temperature values T, the primary data P and the displacement monitoring data x. In the same way, the temperature model 14 is designed to carry out a determination of this kind with respect to the temperature or the temperature profile. The proportion(s) or the temperature is/are determined continuously. In this case, for example, the models 13 and 14 operate as follows.

First of all, the temperature at a specific point of the metal is measured using the pyrometer 11 arranged upstream of the cooling section 2. One or more initial phase proportions can thereby be determined together with the primary data P. From there, the point of the metal is monitored for displacement, in which case the at least one phase proportion or the temperature is continuously tracked in real time, for example by means of the operating parameters S and the velocity v, which influence the temperature or the phase state of the metal 4 and the magnitude of which is known. The displacement monitoring 28 of the points of the metal ends before the coiler 5. This means that the at least one phase proportion is known from the model 13 at any time, at all of the points of the metal 4 monitored for displacement.

The second temperature measurement at the downstream pyrometer 11 is used to check the consistency and for adaptation of the model.

In the metal working line 1 according to various embodiments, the information relating to the phase state of the metal 4 which is received by the model 13 is then not used or not only used for controlling the cooling section 2, but rather the proportion of the at least one phase with respect to a specific location 15 of the cooling section 2, in this case at the end of the cooling section 2, at or shortly after the pyrometer 11, is displayed to an operator by means of the display apparatus 10. This firstly enables continuous monitoring to ensure sufficient quality, and secondly an operator can observe the effect of a change to the operating parameters S in the context of manual control. Additional information which leads to an improvement in the quality of the worked metal 4 and to an increase in safety in the region of the cooling section 2 is therefore available.

In this case, the method according to various embodiments carried out in the cooling section provides not only the determination of the phase proportion(s) taking into account operating parameters and state parameters of the metal 4 and the display of the proportion on the display apparatus 10, but also the possibility of a prognosis. The model 13 is designed to precalculate the effects which a changed control of actuators 6 of the cooling line 2 has on the phase state of the metal 4 at the location 15. This is done by using the current phase proportions of a point of the metal directly before the relevant actuator or the first relevant actuator 6 in order to carry out, on that basis, a precalculation which determines the proportion of the at least one phase to be expected at the location 15, taking into account the current and changed operating parameters S and the further operating parameters, for example the velocity v. This information is also advantageously displayed to the operator after the determination, so that, to observe the influence on the phase distribution, he does not have to wait until a point of the metal worked with the new operating parameters also actually reaches the location 15. A test mode into which the control device 7 can be switched, for example by selecting a corresponding switch panel shown on the display apparatus 10, is also expediently provided, wherein changed operating parameters S are not adopted immediately but rather, for example, only after an operator control element has been activated. However, a prognosis for the location 15 is created and displayed already during the changed control which has not yet been applied, and so an operator can appropriately adapt his setting without producing scrap. The current phase proportions and temperatures present in the models 13 and 14 are also used as the basis for this prognosis.

Figure 2:
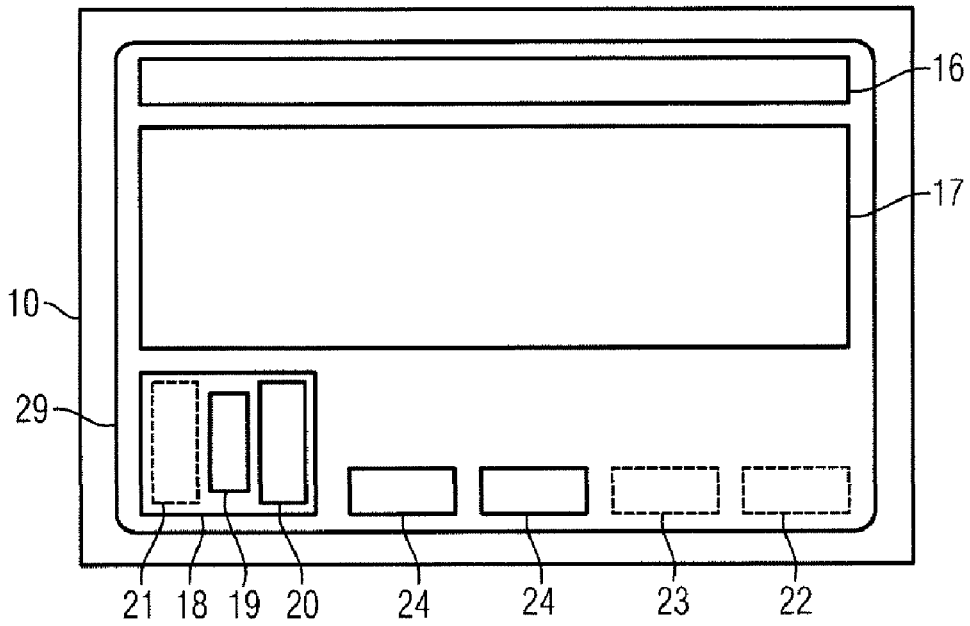
FIG. 2 shows a possible user interface for displaying information or for at least partially manual control of the metal working line.

FIG. 2 shows a possible user interface 29 which can be represented on the display apparatus 10 (a monitor). In this case, general information relating to the metal working line 1 is displayed in a first region 16 and a second region 17 is used to display and set operating parameters S of the actuators 6. The configuration of regions such as these is generally known and does not need to be explained in greater detail here. In addition, however, a region 18 for displaying information relating to the metal 4 is provided. Information 19 relating to the temperature of the metal 4 at the location 15 is displayed in a manner known in principle. In addition, however, a display 20 is provided for the phase proportions of the metal 4 which are currently present at the location 15 and as have been determined by the model 13. In addition, it is also possible to present a prognosis 21 in the region 18 when the control is changed. If the original value before the control is changed is additionally also displayed in 21, direct comparison is possible. Furthermore, the user interface 16 may comprise an operator control element 22 for activating the test mode already described above and a further operator control element 23 for adopting the changed operating parameters input in a test mode. It goes without saying that further operator control elements 24 which can be selected, for example, by controlling a mouse may also be provided, as is known.

FIGS. 3A-3D show different configuration options for the display 20 of the proportion of the at least one phase. FIG. 3A shows a display 20*a* in the form of a pie chart. This shows the proportions of the ferrite and austenite phases and the proportion of further phases.

FIG. 3B shows a display 20*b* in the form of a bar chart. This displays the proportions of the ferrite, austenite, pearlite and cementite phases.

FIG. 3C shows a numerical display 20*c* of the proportions of the ferrite and austenite phases and of other phases.

FIG. 3D shows a possible display 20*d* in the form of color graphics. The proportions of the austenite, pearlite, cementite and ferrite phases are shown on the same scale and with a corresponding length in different colors along a single bar. The boundaries 25 between the colors move according to the changes, as indicated by the arrows 26. In addition, a scale of 0% to 100% may be provided, and so the proportions can also be read off. This provides a particularly intuitive configuration of the display 20*d*. It goes without saying that color coding is also possible in the case of the other displays 20*a*, 20*b* and 20*c*.

When the phase proportions change, each of the representations changes in accordance with the real-time determination of the proportions, and so the user can immediately detect the actual phase distribution—whether in the operating mode or in the test mode.

In addition, the control device 7 is designed to emit a warning message when at least one proportion exceeds or undershoots at least one predetermined value at the location 15. A warning message 27 of this type is shown, by way of example, in FIG. 4. The display apparatus 10 may also comprise an audible component which can produce an audible warning signal. The warning message diverts the operator's attention to the display 20 of the phase state of the metal 4. It is indicated that there is a problem relating to the quality or even a hazardous situation.

What is claimed is:

1. A method for assisting at least partially manual control of a metal working line in which metal in strip or slab form or in a pre-profiled state is worked, the method comprising the steps of:

for each of at least one particular point on the metal:

using a temperature sensor arranged at a first location along the working line, measuring a first temperature of the metal at the particular point on the metal, calculating an initial value for a proportion of at least one metallurgical phase of the metal at the particular point on the metal based at least on the measured first temperature and primary data of the metal, using a displacement monitoring unit to continuously track the displacement of the particular point as the metal moves through the working line, continuously updating the proportion of the at least one metallurgical phase of the metal at the particular point on the metal as the particular point moves along the working line, based at least on the measured displacement of the particular point on the metal, at least one operating parameter of the metal working line that influences the phase state, and measured temperature values from the temperature sensor arranged at the first location along the working line, and displaying the continuously updated proportion of the at least one metallurgical phase of the metal at the particular point on the metal as the particular point moves along the working line.

2. The method according to claim 1, wherein the proportion is determined using a model for determining the phase state of the metal at different points of the metal, wherein displacement monitoring of at least one of the points of the metal and primary data, which describe the metal running into the metal working line and the state of said metal, are taken into account.

3. The method according to claim 1, wherein at least one measuring device for recording state parameters is used.

4. The method according to claim 3, wherein the at least one measuring device is a pyrometer.

5. The method according to claim 1, wherein the metal is worked in a metal working line which is in the form of a cooling section for cooling the metal.

6. The method according to claim 5, wherein the state parameters used are measured values from a first pyrometer, which is arranged upstream of the cooling section, and from a second pyrometer, which is arranged downstream of the cooling section.

7. The method according to claim 1, wherein the proportion is displayed with respect to a location at the end of the working line.

8. The method according to claim 1, wherein, in addition to determining the current proportion, when the control of at least one component of the working line is changed, a prognosis for the future proportion is also determined and displayed taking into account the changed control at the location.

9. The method according to claim 8, wherein a test mode is selected, in which the changed control is not adopted immediately.

10. The method according to claim 1, wherein the proportion of at least one of austenitic, ferritic, pearlitic, cementitic, and further phases is determined and displayed.

11. The method according to claim 1, wherein the proportion is displayed in the form of at least one of a curve, as a pie chart, in numerical form, as a bar chart, and as color graphics.

12. The method according to claim 1, wherein a warning message is emitted when at least one predetermined value for at least one proportion at the location is undershot or exceeded.

13. A metal working line for handling metal in strip or slab form or in a pre-profiled state, having a control device comprising:

a temperature sensor arranged at a first location along the working line, the temperature sensor measuring a first temperature of the metal at a particular point on the metal, a computation unit that calculates an initial value for a proportion of at least one metallurgical phase of the metal at the particular point on the metal based at least on the measured first temperature and primary data of the metal, a displacement monitoring unit that continuously tracks the displacement of the particular point as the metal moves through the working line, wherein the computation unit continuously updates the proportion of the at least one metallurgical phase of the metal at the particular point on the metal as the particular point moves along the working line, based at least on the measured displacement of the particular point on the metal, at least one operating parameter of the metal working line that influences the phase state, and measured temperature values from the temperature sensor arranged at the first location along the working line, and a display apparatus designed to display the continuously updated proportion of the at least one metallurgical phase of the metal at the particular point on the metal as the particular point moves along the working line.

14. The metal working line according to claim 13, wherein the proportion is determined by providing the computation unit with a model for determining the phase state of the metal at different points of the metal, taking into account displacement monitoring of at least one of the points of the metal and primary data which describe the metal running into the metal working line and the state of said metal.

15. The metal working line according to claim 13, wherein it comprises at least one measuring device for recording state parameters.

16. The metal working line according to claim 15, wherein the at least one measuring device is a pyrometer.

17. The metal working line according to claim 13, wherein the metal working line is a cooling section comprising actuators for influencing the temperature of the metal.)

18. The metal working line according to claim 17, wherein a pyrometer is provided both at the start and at the end of the cooling section, wherein the computation unit is designed for taking into account the measured values from the pyrometers as state parameters.

19. The metal working line according to claim 13, wherein the display apparatus is designed for displaying the proportion in the form of at least one of a curve, as a pie chart, in numerical form, as a bar chart, and as color graphics.

20. The metal working line according to claim 13, wherein the metal working line is operable to carry out the method as claimed in claim 1.

* * * * *